US007232346B2

(12) United States Patent
Hu et al.

(10) Patent No.: US 7,232,346 B2
(45) Date of Patent: Jun. 19, 2007

(54) UNIVERSAL SERIAL BUS CONNECTOR WITH ADDITIONAL SIGNAL CONTACTS

(75) Inventors: Lun Song Hu, Kunsan (CN); Hill (Jia-Yong) He, Kunsan (CN); Bo Liu, Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/173,373

(22) Filed: Jun. 30, 2005

(65) Prior Publication Data

US 2006/0025015 A1 Feb. 2, 2006

(30) Foreign Application Priority Data

Jul. 28, 2004 (CN) ..... 2004 2 0078253

(51) Int. Cl.
*H01R 24/00* (2006.01)

(52) U.S. Cl. ..... 439/660; 439/607

(58) Field of Classification Search ..... 439/660, 439/607, 924.1, 608–610
See application file for complete search history.

(56) References Cited

U.S. PATENT DOCUMENTS 4,813,881 A * 3/1989 Kirby ..... 439/74
5,777,868 A * 7/1998 Gibboney, Jr. ..... 363/146
5,902,154 A * 5/1999 Nakata ..... 439/660
5,980,325 A * 11/1999 Horchler ..... 439/660
6,036,549 A * 3/2000 Wulff ..... 439/660
6,113,426 A * 9/2000 Lin ..... 439/607
6,270,379 B1 * 8/2001 Huang et al. ..... 439/660
6,334,793 B1 * 1/2002 Amoni et al. ..... 439/680
6,371,771 B1 * 4/2002 Fan ..... 439/79
6,447,340 B1 * 9/2002 Wu ..... 439/660
6,508,676 B1 * 1/2003 Xu ..... 439/660
6,679,733 B2 * 1/2004 Crane et al. ..... 439/660
6,699,049 B1 * 3/2004 Wu ..... 439/79
6,786,770 B1 * 9/2004 Huang ..... 439/607
6,796,839 B1 * 9/2004 Wu ..... 439/607
6,908,339 B2 * 6/2005 Tanaka ..... 439/607
7,021,971 B2 * 4/2006 Chou et al. ..... 439/660
7,108,560 B1 * 9/2006 Chou et al. ..... 439/660
2005/0059273 A1 * 3/2005 Chiou et al. ..... 439/76.1
2005/0070138 A1 * 3/2005 Chiou et al. ..... 439/76.1

* cited by examiner

*Primary Examiner*—Gary F. Paumen
(74) *Attorney, Agent, or Firm*—Wei Te Chung

(57) ABSTRACT

An electrical connector compatible to standard USB connector includes an insulative housing forming a tongue (12) extending forwardly, a plurality of first and second contacts (22) mounted to the housing, and a shell (30) enclosing the housing. The tongue defines a plurality of passageways (14, 19) in a longitudinal direction. Each first contact has a first beam (213) received in a corresponding passageway and each first contact has a first contact portion in a front portion thereof. Each second contact includes a second beam (223) received in a corresponding passageway and each second contact includes a second contact portion in a front portion thereof. The first beams of the first contacts and the second beams of the second contacts are alternatively arranged in the passageways.

18 Claims, 9 Drawing Sheets

UNIVERSAL SERIAL BUS CONNECTOR WITH ADDITIONAL SIGNAL CONTACTS

BACKGROUND OF THE INVENTION

1. Field of the Invention

The present invention relates to electrical connectors, more particularly to electrical connectors compatible to standard Universal Serial Bus connectors.

2. Description of the Prior Art

Universal Serial Bus (USB) male and female connectors are commonly employed in electronic systems, such as the computer, consumer or communication industries etc, for signal transmission purposes. A conventional USB female connector includes four signal contacts electrically connected to a mother board and a conventional USB male connector electrically connecting with cable wires. The signal contacts of the female connector engage with the male connector, thereby transmitting signals through the cable and the mother board.

However, nowadays the electronic systems are provided more friendly functions through connections of electrical connectors. It is then desirable to integrate more functions in conventional connectors, especially the standard USB connectors which are popularly used. As a result, one requester has asked to provide a new combo type receptacle connector which defines a similar mating space with the standard USB connector while including additional contacts in comparison with the standard USB connector so as to be compatible not only the standard USB connector but also the new combo type plug connector.

BRIEF SUMMARY OF THE INVENTION

It is an object of the present invention to provide an electrical connector assembly compatible with standard USB connectors with additional signal contacts.

In order to attain the objective above, an electrical connector compatible to standard USB connector includes an insulative housing forming a tongue extending forwardly, a plurality of first and second contacts mounted to the housing, and a shell enclosing the housing. The tongue defines a plurality of passageways in a longitudinal direction. Each first contact has a first beam received in a corresponding passageway and each first contact has a first contact portion in a front portion thereof. Each second contact includes a second beam received in a corresponding passageway and each second contact includes a second contact portion in a front portion thereof. The first beams of the first contacts and the second beams of the second contacts are alternatively arranged in the passageways.

Other objects, advantages and novel features of the invention will become more apparent from the following detailed description of the present embodiment when taken in conjunction with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE INVENTION

Reference will now be made in detail to the preferred embodiment of the present invention.

Figure 1:
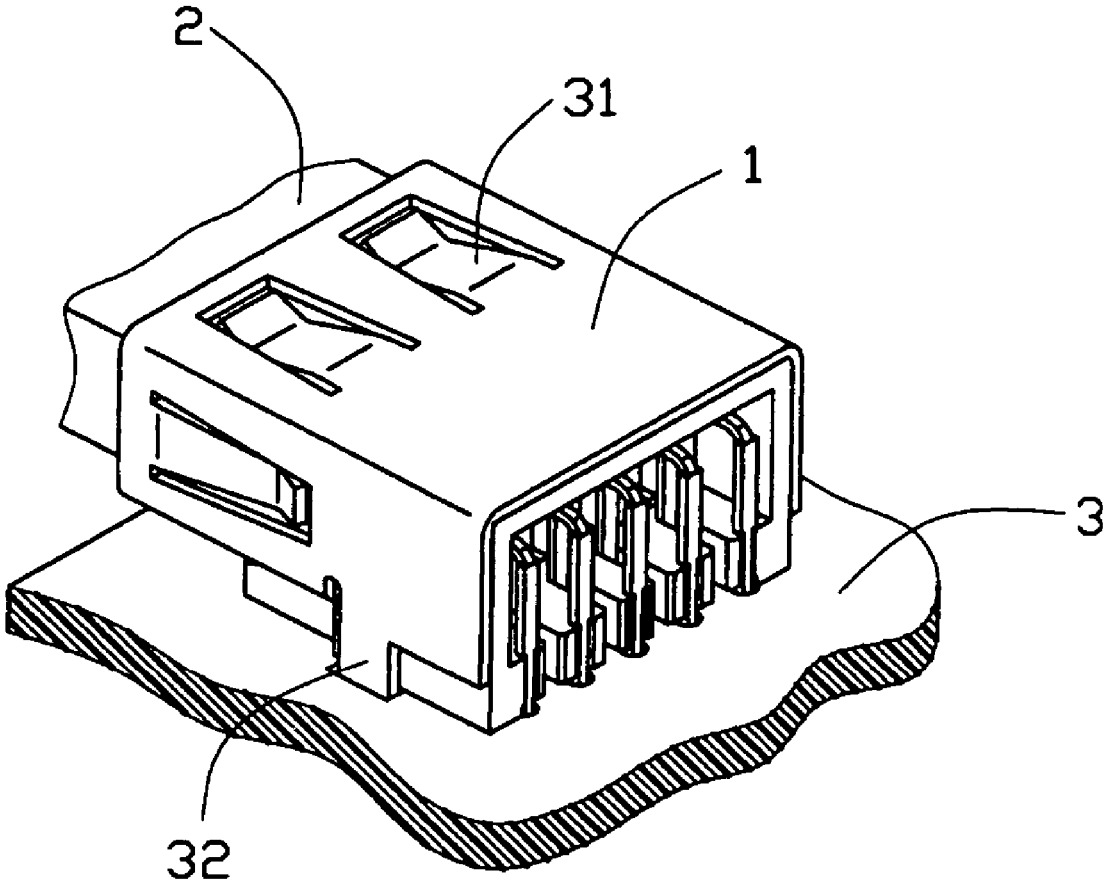
FIG. 1 is a perspective view of a female connector engaging with a male connector according to a preferred embodiment of the present invention.
Figure 2:
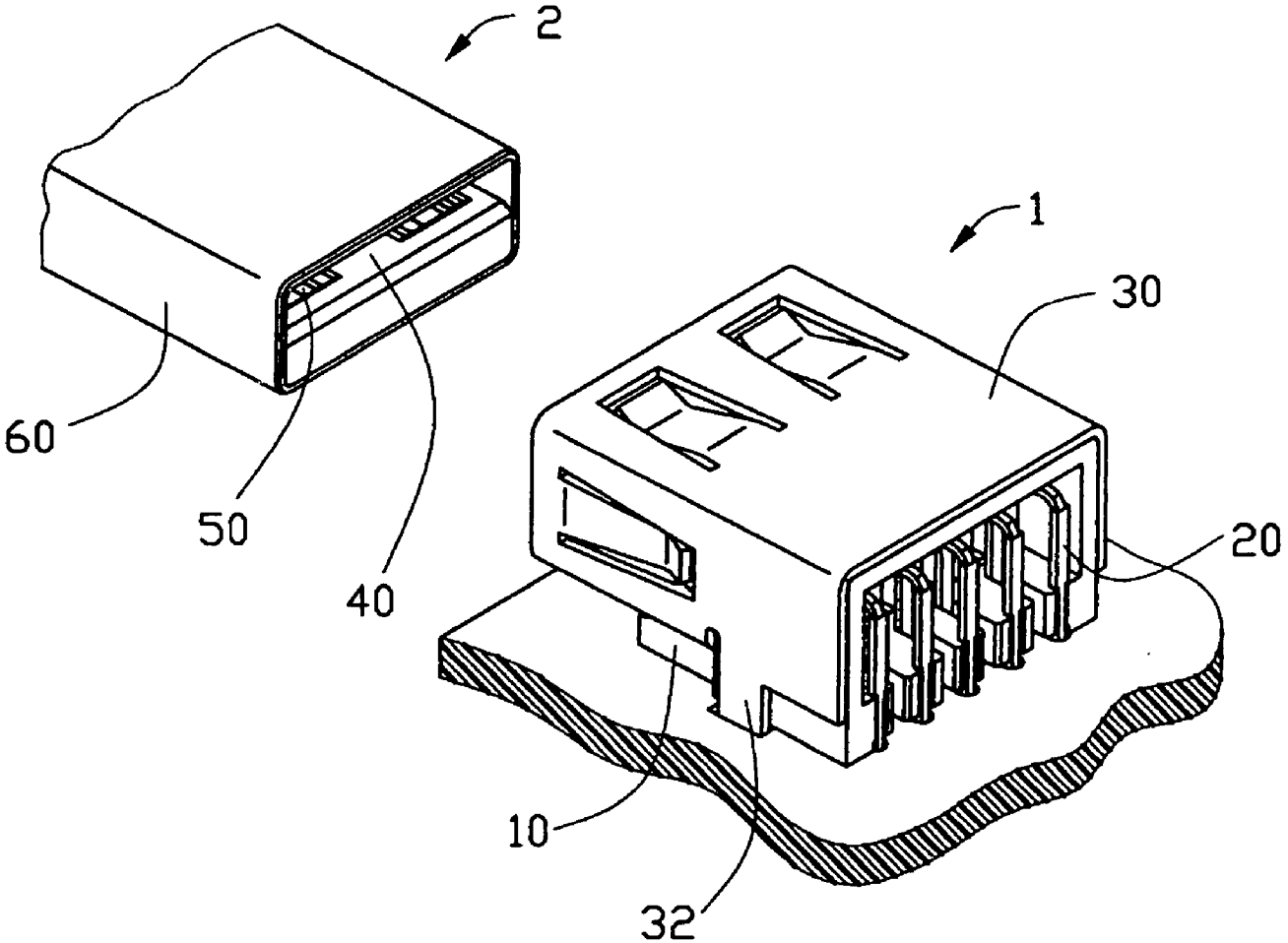
FIG. 2 is a perspective view of the female and male connectors disengaging from each other.

FIGS. 1 and 2 show a female connector 1 and a complementary male connector 2 according to the present invention. The female connector 1 is mounted on a mother board 3. The male connector 2 is a cable end connector connecting with a cable (not shown).

Figure 3:
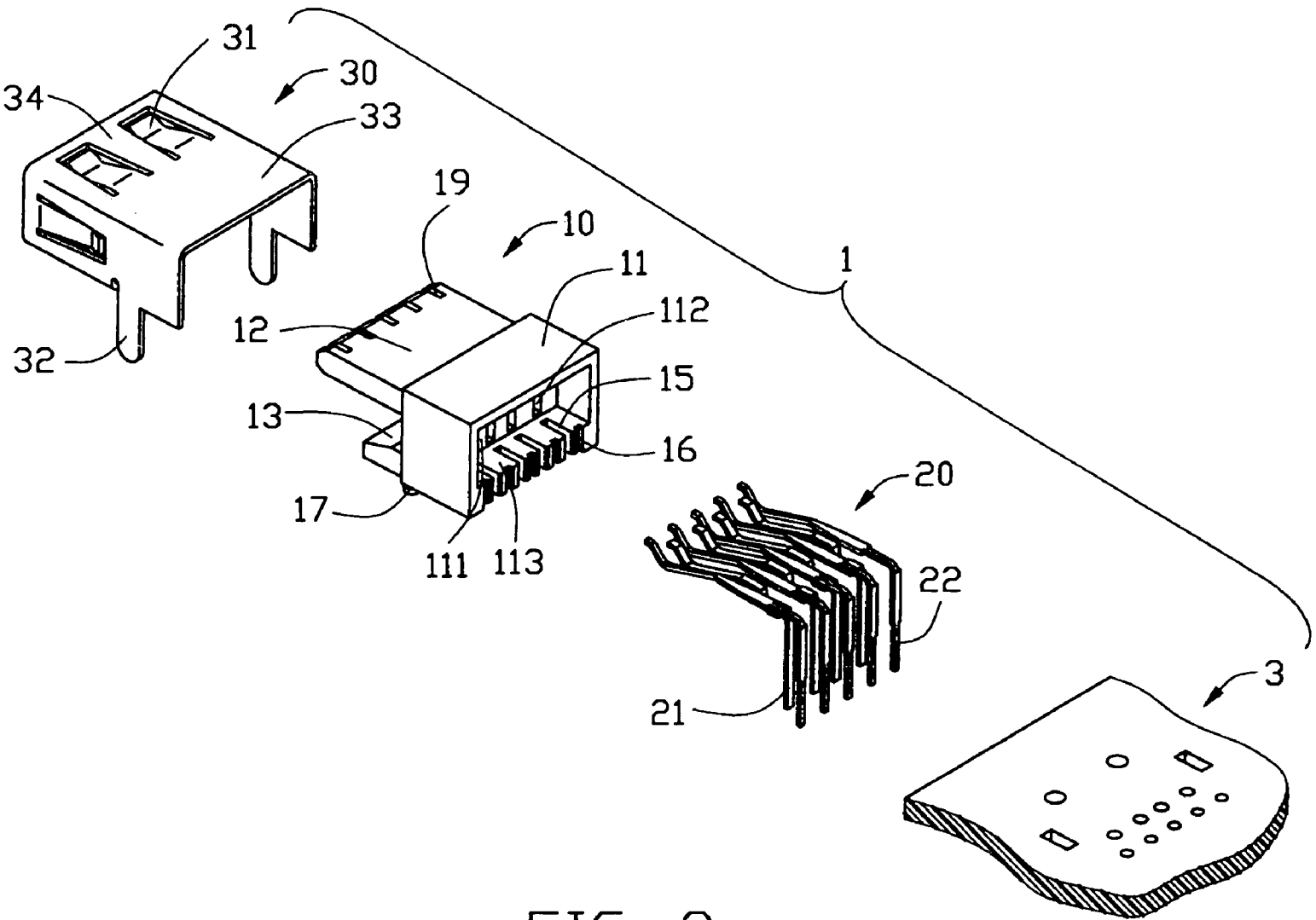
FIG. 3 and FIG. 4 are exploded views of the female connector from different aspects.
Figure 4:
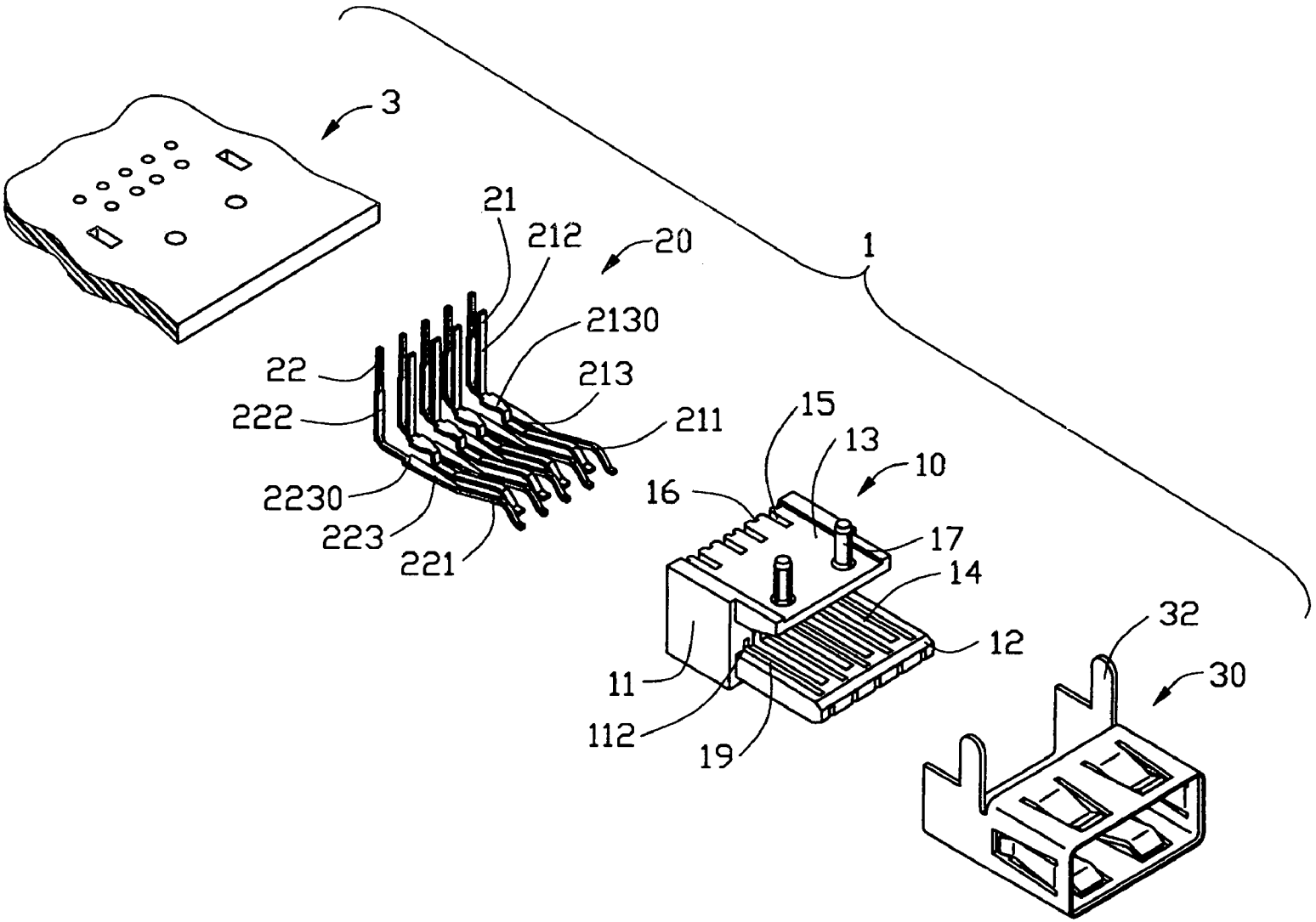

Referring to FIGS. 3 and 4, the female connector 1 includes an insulating housing 10, a plurality of first and second electrical contacts 21, 22 mounted on the housing 10, and a shell 30 made of metal or metallic material or alloy for enclosing the housing 10.

The housing 10 is made of synthetic resin or other insulative material and includes a rear body portion 11, a tongue 12 extending forwardly from an upper portion of the body portion 11, and a base wall 13 extending forwardly from a bottom portion of the body portion 11. The body portion 11 is a substantially squared box having a rear opening (not labeled), a front wall 111 from which the tongue 12 extending forwardly, and a lower wall 113 having a lower surface coplanar with a bottom surface of the base wall 13. A first set of slots 15 and a second set of slots 16, for respectively alignment of the first and second contacts 21, 22, are alternatively arranged in a rear portion of the lower wall 113 along a literal direction of the housing 10 and further extending forwardly toward the front wall 111. Each first slot 15 is relatively longer than an adjacent second slot 16. The front wall 111 defines a plurality of grooves 112 extending therethrough in the front-to-back direction. Each groove 112 is aligned with a corresponding first or second slot 15, 16 in the front-to-back direction. A plurality of first and second passageways 14, 19 are defined in a lower surface of the tongue 12 in an alternative arrangement. Each first and second passageway 14, 19, a corresponding groove 112 and a corresponding first or second slot 15, 16 are aligned in the front-to-back direction. Each second passageway 19 extends forwardly beyond an adjacent second passageway 14. Front end of each second passageway 19 extends though upper and lower surface of the tongue 12. A pair of mounting posts 17 extends downwardly from the lower surface of the base wall 13 for being mounted in mounting holes (not labeled) in the mother board 13.

In conjunction with FIGS. 1–2, the first contacts 21 is designated to contact with Universal Serial Bus (USB) male contacts and the second contacts 22 are additional signal contacts for signal expansion. Each first contact 21 is substantially right angle and has a straight tail portion 212 extending downwardly through a corresponding first slot 15 of the housing 10, a flexible beam 213 extending forwardly through the front wall 111 of the rear body portion 11 and right angularly with respect to the tail portion 212, and an enlarged intermediate portion 2130 connecting the tail portion 212 and the flexible beam 213 and retained in a corresponding groove 112. Each flexible beam 213 is retained in a corresponding first passageway 14. Each enlarged intermediate portion 2130 is substantially parallel to the flexible beam 213 and spaced from the flexible beam 213 in the upper-to-lower direction. Each flexible beam 213 includes a curved front free end having a first lower contact portion 211 partially exposed out of the corresponding first passageway 14.

Each second contact 22 includes a second tail portion 222 extending downwardly through a corresponding second slot 16, and a second flexible beam 223 extending forwardly and right angularly with respect to the second tail portion 222. Each second flexible beam 223 extends through a corresponding groove 112 and further retained in a corresponding passageway 19. The second flexible beams 223 extend forwardly beyond the first flexible beams 21. Each second contact 22 includes a curved front free end having a second lower contact portion 221 partially exposes out of the corresponding second passageway 19.

The shell 30 includes a rear shell portion 33 for shielding the rear body portion 11 of the housing 10, and a front shell portion 34 extending forwardly for enclosing the tongue 12 and bottom plate 13 of the housing 10. The rear shell portion 33 forms a pair of mounting legs 32 extending downwardly to secure the connector to the PCB 3, together with the mounting posts 17 of the housing 10. A plurality of elastic arms 31 is integrally stamped inwardly in the periphery of the front shell portion 34 for retaining the connectors in mated relationship and/or engaging with outer surfaces of the male connector 2 for grounding. The receiving space defined by the shell 30 and the tongue 12 of the housing 10 and the arrangement of the first contacts 21 in the housing 10 are compatible to Standard USB connectors.

Figure 5:
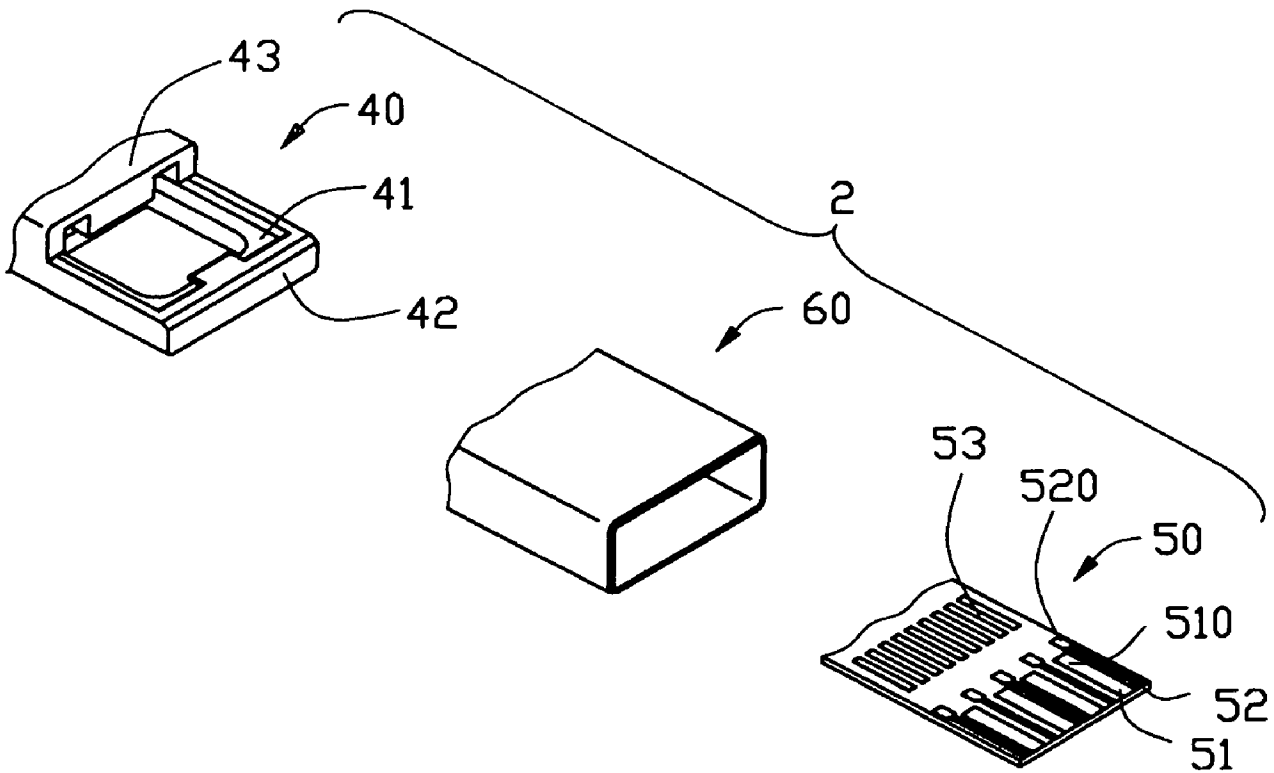
FIG. 5 is an exploded view of the male connector.
Figure 6:
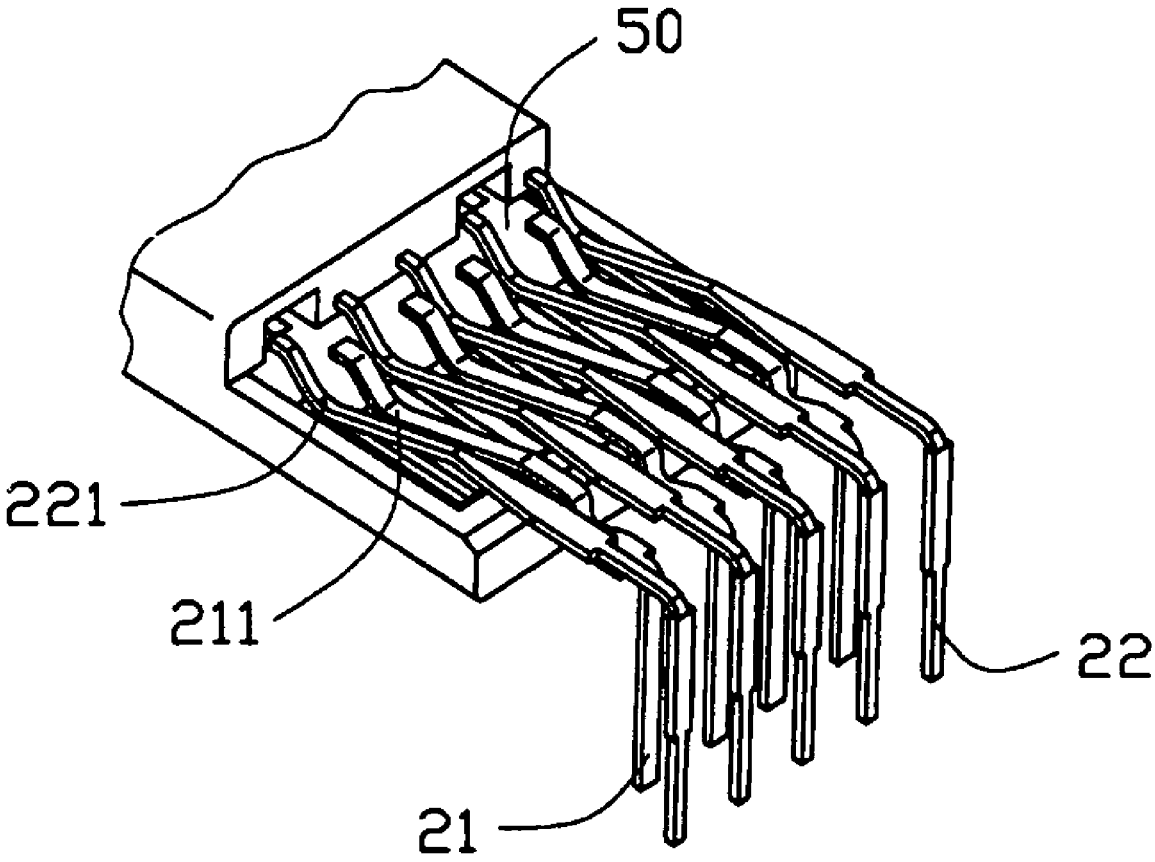
FIG. 6 is a schematic view showing contacts of the female connector engaging with signal contact pads of the male connector.

Referring to FIGS. 2 and 5, the male connector 2 includes an insulative base 40, an interior PCB 50 mounted to the base 40 and a shield 60 enclosing the base 40 and the interior PCB 50. The base 40 is provided with a front block 43 having a front end omitted, and a rear plate 42 extending rearwardly from a lower portion of the front block 43. The rear plate 42 defines a recessed portion 41 in an upper portion thereof. The recessed portion 41 extends forwardly through the rear block 43.

The interior PCB 50 forms a plurality of first and second and third golden fingers 51, 52, 53 on a top surface thereof. The first and second golden fingers 51, 52 are alternatively arranged on a rear portion of the interior PCB 50 in the lateral direction. Each first golden finger 51 has a first contact pad 510 on a front end thereof. Each second golden finger 52 includes a relatively thin body (not labeled) and an enlarged second contact pad 520 on a front end beyond the first golden fingers 51. The thin body of the second golden fingers 52 and the first golden fingers 51 are alternatively arranged in said literal direction. The third golden fingers 53 are formed on a front portion of the interior PCB 50 and electrically connected to the first and second signal golden fingers 51, 52 through conductive wires (not shown) in the interior PCB 50.

The interior PCB 50 is inserted to located in the recessed portion 41 of the base 40 in the back-to-front direction with the first and second golden fingers 51, 52 exposed to the upper portion of the plate 42 and the third golden fingers 53 extending through the front block 43 for connecting with conductors of the cable.

Referring to FIGS. 1 to 6, the male connector 2 and the female connector 1 are engaged with each other. The elastic arms 31 of the female connector 1 abut against an outer surface of the shield 60 of the male connector 2 for retaining the connectors in the mated relationship and for grounding. Particularly referring to FIG. 6, the first contact portions 211 of the female connector 1 mechanically and electrically connect with respective first contact pads 510 of the male connector 2. The second contact portions 221 of the female connector 1 mechanically and electrically connect to respective second contact pads 520 of the male connector 2, whereby, the standard USB signal and expansion signal can be delivered simultaneously without changing the sized of the male and female connectors 2, 1.

Figure 7:
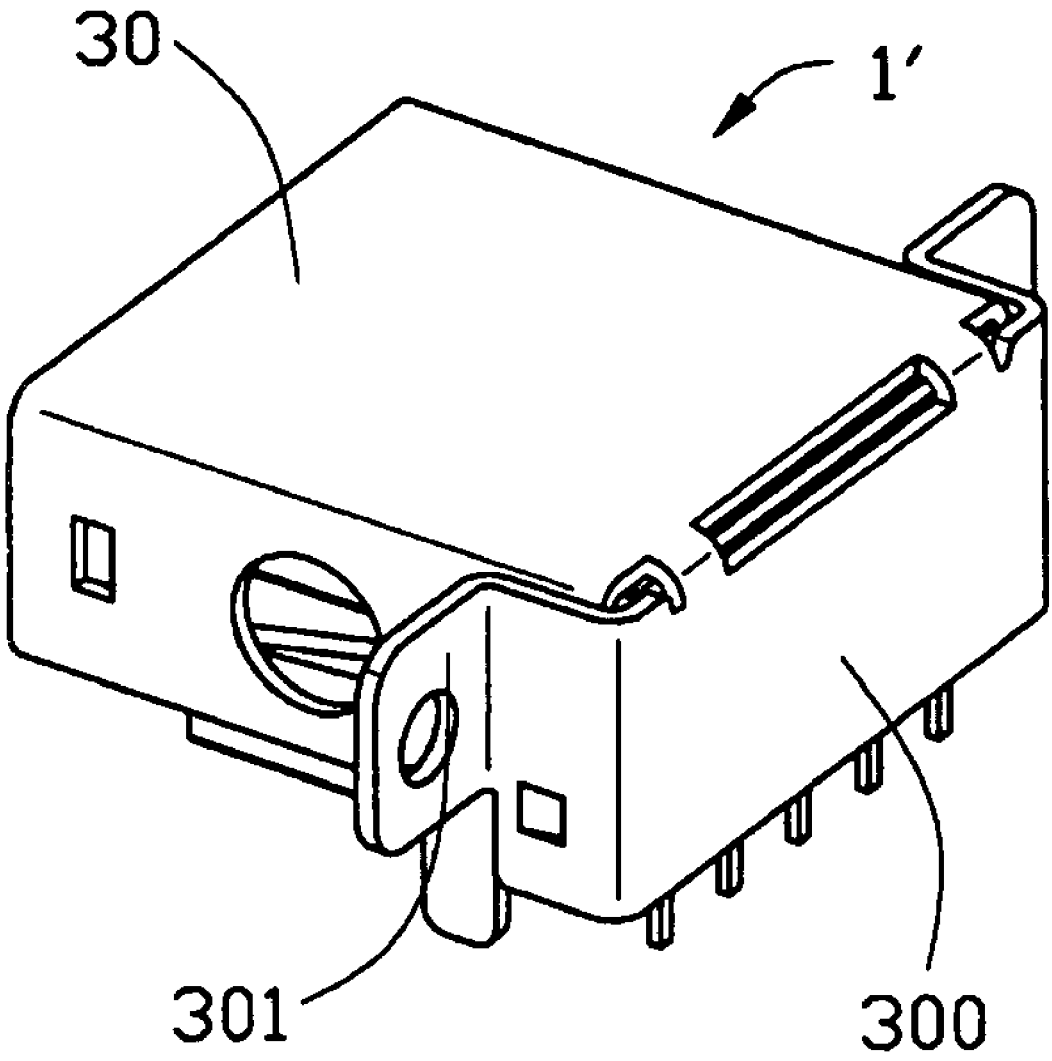
FIG. 7 shows a perspective view of a female connector according to a second embodiment of the present invention.
Figure 8:
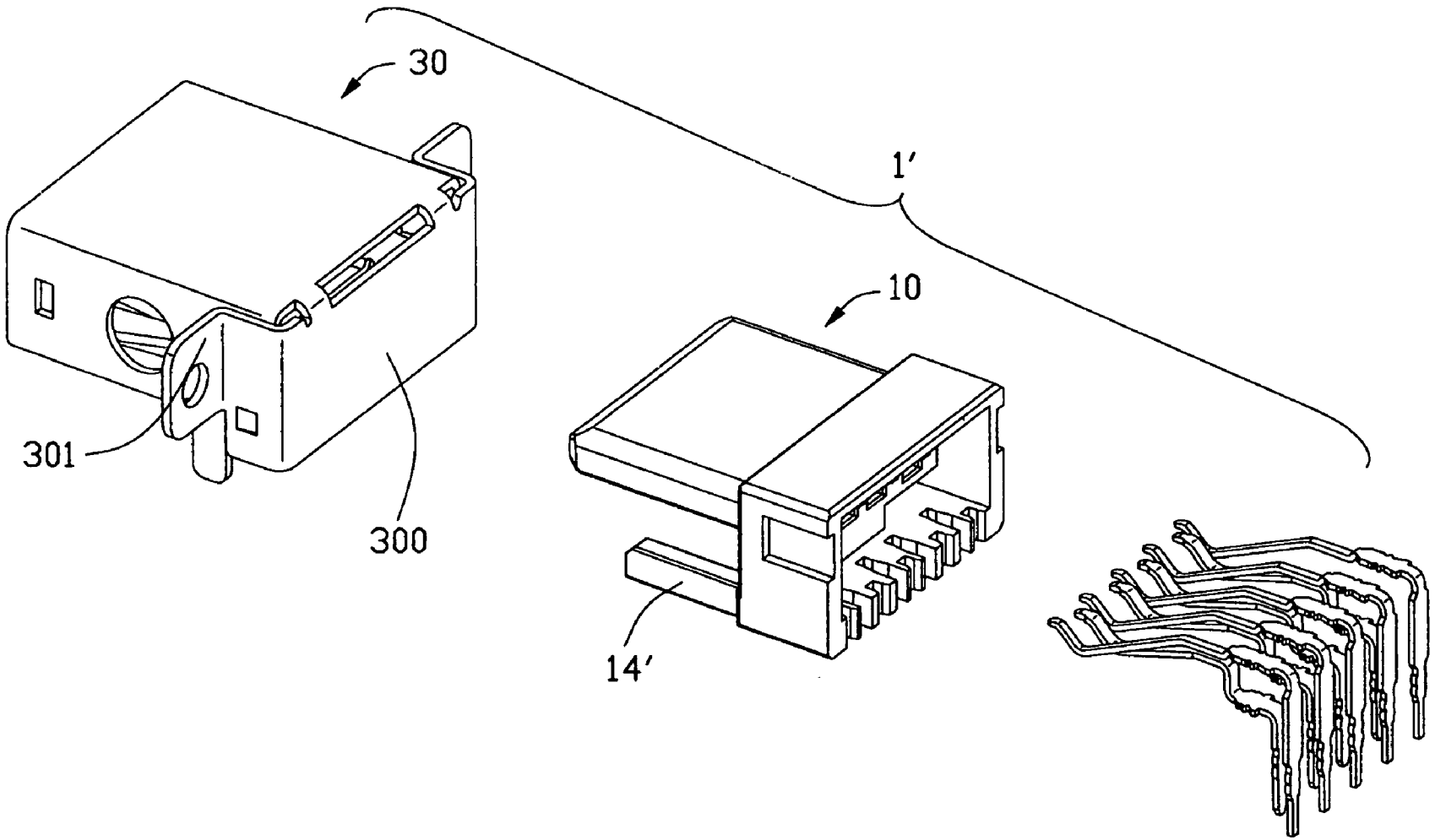
FIG. 8 is an exploded view of FIG. 7.
Figure 9:
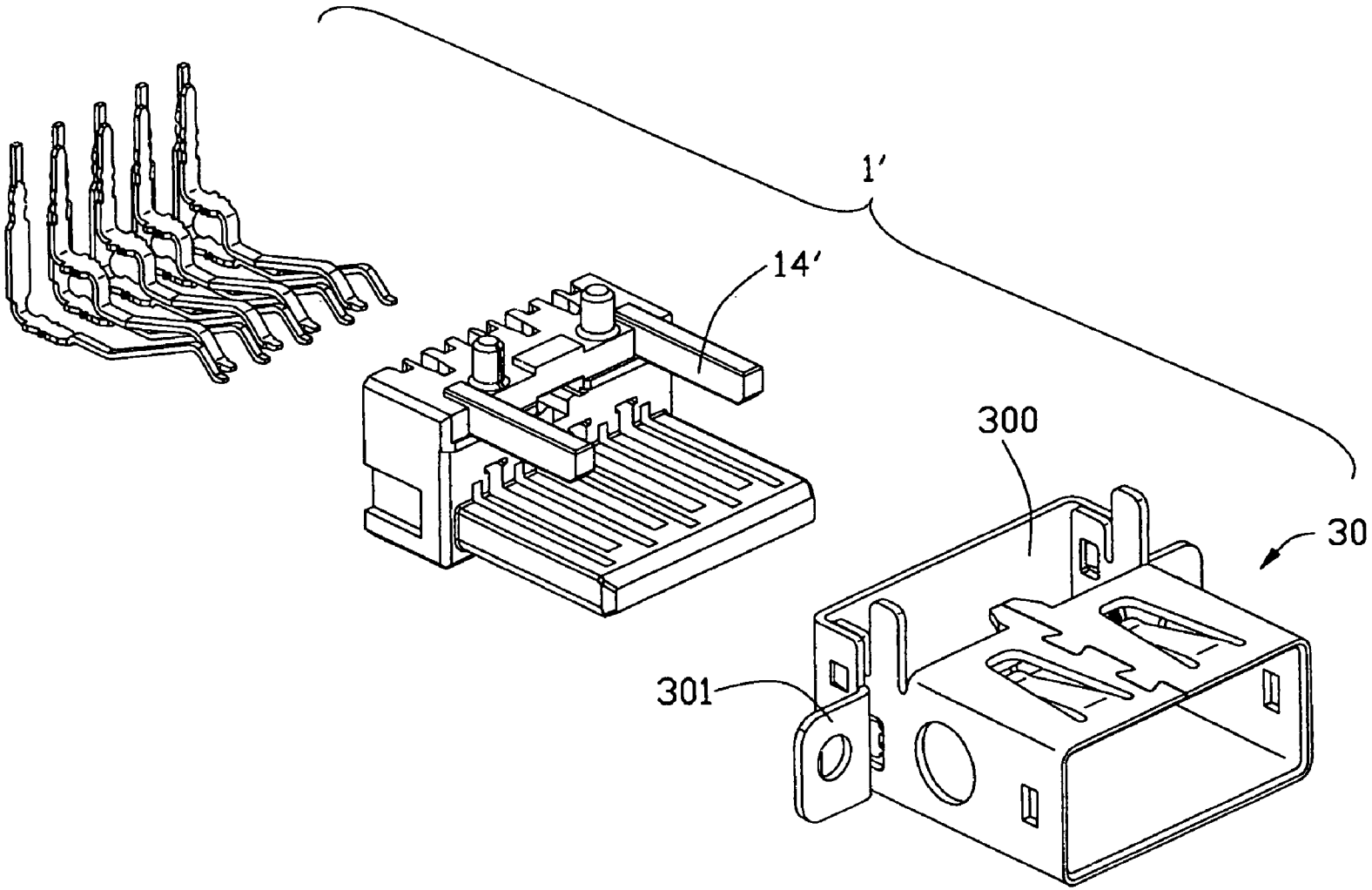
FIG. 9 is another exploded view of the female connector of FIG. 8 from a different aspect.

FIGS. 7–9 show another preferred embodiment of the female connector 1' according to the present invention. The bottom plate 13 of the housing 10 in FIG. 4, in the first preferred embodiment, is substituted by a pair of pillars 14' extending forwardly, which is much more economic by saving material. Moreover, the shell 30 of the female connector 1 in the second embodiment includes a rear plate 300 depending downwardly from a rear end of the rear shell portion 33 for enclosing rear portion of the housing 10. A pair of L-shaped ears 301 are respectively formed on opposite sides of the rear plate 300. Each ear 301 includes a mounting hole (not labeled) for mounting the female connector 1' to a computer or the like.

The feature of the invention is that to reserving enough space between every adjacent two contacts of the standard connector for allowing arranging the second contacts 22 alternately with the first contacts 21, in this embodiment the first contacts 21 and the associated first slot 15 are narrower than the traditional contacts/passgeways of the standard USB connector, e.g., the standard contact being roughly dimensioned with 1 mm width while the first contact being dimensioned with 0.6 mm instead. Anyhow, such reduction of the width of the standard contact of the standard USB connector will not jeopardize the electrical transmission because the first contact pad 510 on the complementary connector 2 still keep the original wide dimension. On the other hand, even though the first contact 21 is narrowed from the standard contact of the standard USB connector, the first contact 21 (0.6 mm) is still wider than the second contact 22 (0.3 mm). Understandably, the relatively narrower second contact 22 will not jeopardize the electrical transmission because the counter part second contact pad 520 is still large enough for the desired electrical transmission.

It is to be understood, however, that even though numerous, characteristics and advantages of the present invention have been set fourth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. A female connector compatible to standard Universal Serial Bus (USB) connector and adapted for being mounted on a mother board, comprises:

an insulative housing including a body portion and a tongue extending forwardly from the body portion, the tongue defining a plurality of passageways in a planar surface;

a plurality of first contacts mounted on the housing, each first contact including a first tail portion connecting to the mother board and a beam extending forwardly from the tail portion, each first beam including a contact portion on a front free end thereof, each first beam being received in a corresponding passageway with the contact portion extending beyond the planar surface of the tongue;

a plurality of second contacts mounted on the insulative housing, each second contact including a second tail portion connected to the mother board and a second beam extending forwardly from the second tail portion, each second beam being received in a corresponding passageway with the second contact portion extending out of the planar surface of the tongue, the second contact portions being spaced from the first contact portions in a front-to-rear direction; and a metal shell enclosing the insulative housing the metal shell including a front shell portion enclosing the tongue and defining a receiving space around the tongue for receiving a mating connector therein, the receiving space and the arrangement of the first contacts, other than the second contacts, in the insulative housing being compatible to a Standard USB connector; wherein the first contacts are narrower than contacts of the Standard USB connector.

2. The female connector according to claim 1, wherein the first and second contacts are alternatively arranged on the insulative housing.

3. The female connector according to claim 1, wherein the first and the second tail portions of the first and second contacts are arranged in two rows, each tail portion being spaced from an adjacent tail portion in the front-to-back direction.

4. The female connector according to claim 3, wherein the body portion of the insulative housing defines a plurality of first and second slots penetrate thereinto in the front-to-back direction at a rear end thereof for alignment of the first and the second tail portions, and wherein the first slots are deeper than the second slots into the body portion of the insulative housing.

5. The female connector according to claim 1, wherein the shell of the female connector includes a rear plate enclosing a rear portion of the insulative housing.

6. The female connector according to claim 5, wherein said rear plate has a pair of L-shaped ears respectively formed on opposite sides thereof.

7. The female connector according claim 6, wherein each ear includes a mounting hole.

8. The female connector according to claim 1, wherein said first contacts are wider than the second contacts.

9. An electrical connector compatible to standard USB connector, comprising:

an insulative housing forming a tongue extending forwardly, the tongue defining a plurality of passageways in a longitudinal direction;

a plurality of first contacts mounted to the insulative housing, each first contact having a first beam received in a corresponding passageway, each first contact having a first contact portion at a front portion thereof;

a plurality of second contacts mounted to the insulative housing, each second contact having a second beam received in a corresponding passageway, each second contact having a second contact portion at a front portion thereof, the first beams of the first contacts and the second beams of the second contacts being alternately arranged; and a metal shell enclosing the insulative housing and forming a receiving space for receiving a mating connector therein, the receiving space and the arrangement of the first contacts in the insulative housing being compatible to a Standard USB connector; wherein the first contacts are narrower than contacts of the Standard USB connector.

10. The electrical connector according to claim 9, wherein the first contact portions are spaced from the second contact portions in the longitudinal direction.

11. The connector according to claim 9, wherein the first and the second tail portions of the first and second contacts are arranged in two rows, each tail portion being spaced from an adjacent tail portion in the longitudinal direction.

12. The connector according to claim 11, wherein a body portion of the insulative housing defines a plurality of first and second slots in a rear end thereof and penetrating thereinto in the front-to-back direction for alignment of the first and the second tail portions, respectively, and wherein the first slots are penetrating into the body portion deeper than the second slots.

13. The connector according to claim 9, wherein said first contacts are wider than the second contacts.

14. The connector according to claim 10, wherein the second contact portions are located in front of said first contact portions along said longitudinal direction.

15. An electrical connector mounting on a mother board, comprising:

an insulative housing defining a tongue extending forwardly, the tongue defining a plurality of passageways in a planar surface thereof;

a plurality of first contacts mounted on the insulative housing, each first contact including a first tail portion connecting to the mother board and a first deflectable beam extending forwardly from the tail portion, each first beam including a first contact portion and being received in a corresponding passageway with the contact portion extending out of the planar surface of the tongue;

a plurality of second contacts mounted on the insulative housing, each second contact including a second tail portion connecting to the mother board and a second flexible beam extending forwardly from the second tail portion, each second beam comprising a second contact portion and being received in a corresponding passageway with the second contact portion extending out of the planar surface of the tongue, the second contact portions being spaced from the first contact portions in a front-to-rear direction;

an arrangement of the first contacts, other than the second contacts, in the housing and the receiving space being compatible to a Standard USB connector; and wherein the first contacts are narrower than contacts of the Standard USB connector.

16. The electrical connector assembly according to claim 15, wherein said first contacts are wider than the second contacts.

17. The electrical connector assembly according to claim 15, wherein the second contact portions are located in front of that of the first contacts.

18. The electrical connector assembly according to claim 15, wherein the first and second contacts are alternately arranged on the insulative housing.

* * * * *